US005816469A

United States Patent [19]

Ohuchi

[11] Patent Number: 5,816,469

[45] Date of Patent: Oct. 6, 1998

[54] FASTENER DRIVING MACHINE

[75] Inventor: Haruhiko Ohuchi, Ibaraki, Japan

[73] Assignee: Hitachi Koki Co., Ltd., Tokyo, Japan

[21] Appl. No.: 742,751

[22] Filed: Nov. 1, 1996

[30] Foreign Application Priority Data

Nov. 2, 1995 [JP] Japan ..... 7-285656

[51] Int. Cl.[6] ..... B25C 1/04

[52] U.S. Cl. ..... 227/119; 227/120; 227/156

[58] Field of Search ..... 227/109, 119, 227/120, 107, 135, 136, 139, 156

[56] References Cited

U.S. PATENT DOCUMENTS 3,037,207 6/1962 Pazan ..... 227/109
4,375,867 3/1983 Novak et al. ..... 227/109
4,389,012 6/1983 Grikis et al. ..... 227/120
4,463,888 8/1984 Geist et al. ..... 227/109

*Primary Examiner*—Scott A. Smith
*Attorney, Agent, or Firm*—Sughrue, Mion, Zinn, Macpeak & Seas, PLLC

[57] ABSTRACT

A fastener driving machine includes a machine body, a nose structure, a magazine, a guide member, a feeder and grooves. The nose structure is fastened to the machine body and ejects fasteners. The magazine is made of resin and accommodates rows of collated fasteners. The guide member, disposed in the magazine, is made of metal and has a pair of opposing surfaces. The feeder feeds the collated fasteners to the nose structure while the collated fasteners are guided between the opposing surfaces of the guide member. The grooves support the guide member in the magazine so as to allow the guide member to longitudinally expand or contract with a change in temperature.

16 Claims, 3 Drawing Sheets

FASTENER DRIVING MACHINE

BACKGROUND OF THE INVENTION

1. Field of the Invention

The present invention relates to a machine for driving fasteners such as nails in collated form.

2. Description of the Related Art

The general structure of a nail driving machine for driving collated nails is shown in FIG. 5. A plurality of nails 3 which are concatenated so as to be uniformly oriented are referred to as collated nails 6. The nail driving machine includes a magazine 2 and a machine body 5 to which a nose structure 1 is fastened. The nose structure 1 defines a drive track through which the nails 3 pass to be ejected outside. A row of collated nails 6 is loaded in the magazine 2 from above. In general, two or three rows of collated nails 6 can be loaded in the magazine at a time. In the magazine 2, with the heads 3*b* of the nails 3 supported, the nails 3 are fed along the passageway formed longitudinally in the magazine 2. A feeder 7 operates to move several rows of collated nails 6 towards the nose structure 1 with the aid of the elastic force of a spring (not shown). Of the collated nails 6 fed to the nose structure 1, the top one is driven into wood or the like by a driver blade (not shown).

Conventionally, the magazine 2 is made of a metal such as steel, aluminum or magnesium. To meet the strong demand for reduction of the weight of the nail driving machine, various parts of the machine are made of resin. Recently, a relatively small nail driving machine has been made which employs a magazine 2 made of resin. However, the use of a resin magazine has not been practical for a relatively large nail driving machine as shown in FIG. 5, because of the large shock applied to the collated nails 6 during operation of the machine, which causes the nail passageway of the magazine 2 to gradually wear and increase in width. As a result of this wear, the top collated nails 6 overlap with the following collated nails 6 at their junction; that is, the nails jam in the magazine 2, so that no nail 3 is fed to the nose structure 1.

In order to overcome this difficulty, some conventional large nail driving machines employ a magazine structure as shown in FIGS. 6 and 7. Guide members 4 of steel, which do not wear appreciably, are fixedly secured to the inner surfaces of both side walls of the resin magazine 2 with screws 8. Hence, the space formed between the right and left guide members 4 is the nail passageway.

However, a problem arises with this arrangement because the resin forming the magazine 2 is different in thermal expansion coefficient from the steel forming the guide members 4; that is, the resin has a much larger thermal expansion coefficient than the steel. Hence, when the environmental temperature where the nail driving machine is in use changes, the magazine 2 and the guide members 4 expand or contract at different rates. As a result, the magazine 2 and the guide members 4 are bent like a bimetal plate; that is, the nail passageway defined by the guide members 4 is deformed. Because of this deformation, it becomes impossible to load a row of collated nails 6 in the magazine 2, or it becomes difficult to feed the nail 3 to the nose structure 1.

In summary, the conventional large nail driving machine suffers from the disadvantage that, if guide members 4 of steel are employed in order to prevent wear of the magazine 2, the guide members 4 bend when the temperature of the magazine 2 changes according to the environmental temperature where the nail driving machine is in use. Therefore, it is not preferable to form the magazine 2 from resin, and accordingly it is difficult to decrease the weight of the nail driving machine.

SUMMARY OF THE INVENTION

An object of the present invention is to form a magazine, even one to be used in a large nail driving machine, from resin to thereby reduce the weight thereof.

The foregoing object of the invention has been achieved by the provision of a fastener driving machine in which guide members are supported in the magazine so as to allow the guide members to longitudinally expand or contract according to a change in temperature, thereby preventing the guide members from bending.

DETAILED DESCRIPTION OF THE PREFERRED EMBODIMENT

A preferred embodiment of the invention will be described with reference to the accompanying drawings.

Figure 2:
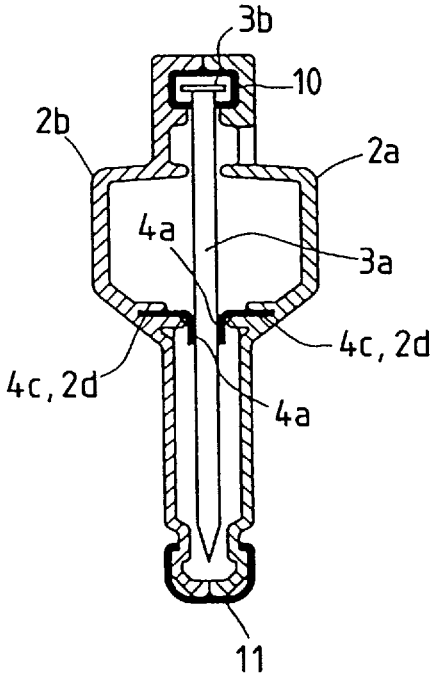
FIG. 2 is a sectional view of a preferred embodiment of the invention taken along the line 2—2 in FIG. 5.
Figure 3:
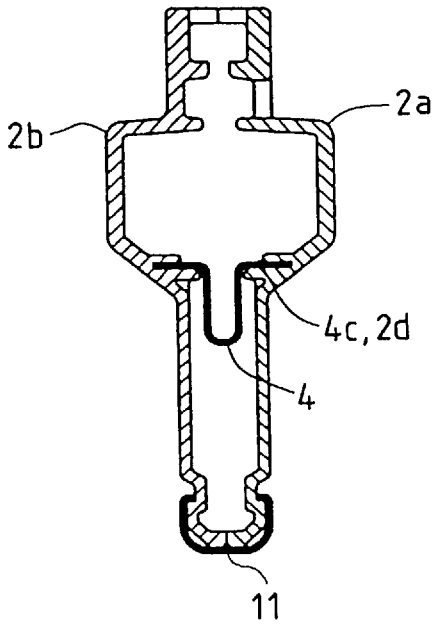
FIG. 3 is a sectional view of a preferred embodiment of the invention taken along the line 3—3 in FIG. 5.
Figure 5:
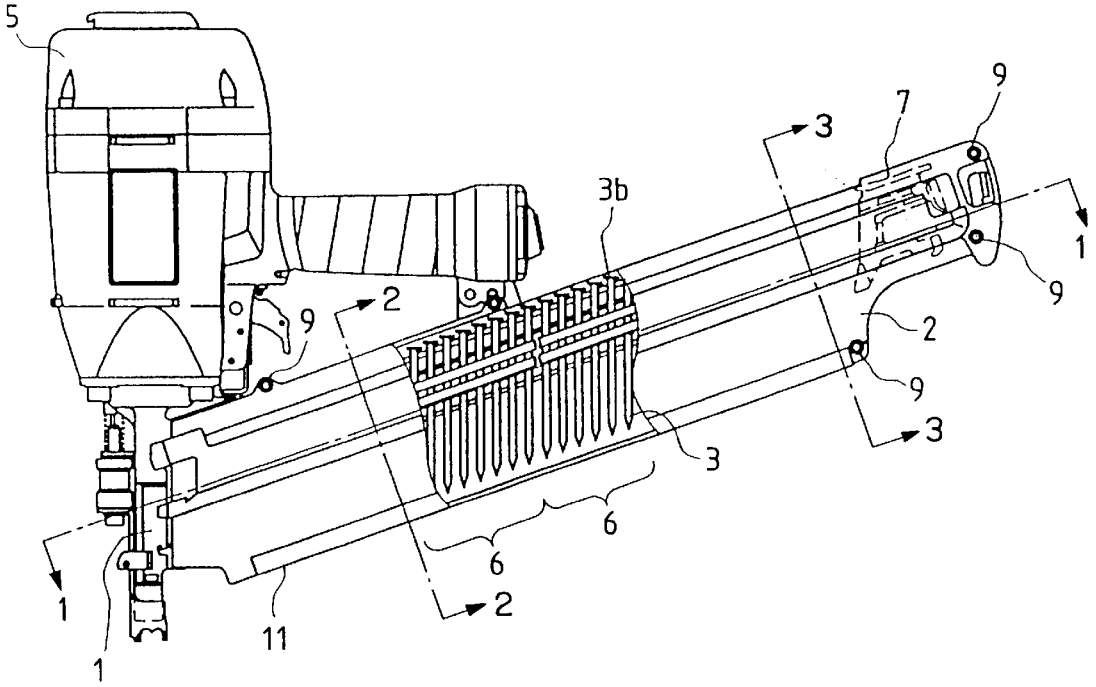
FIG. 5 is a side view of a fastener driving machine.
Figure 6:
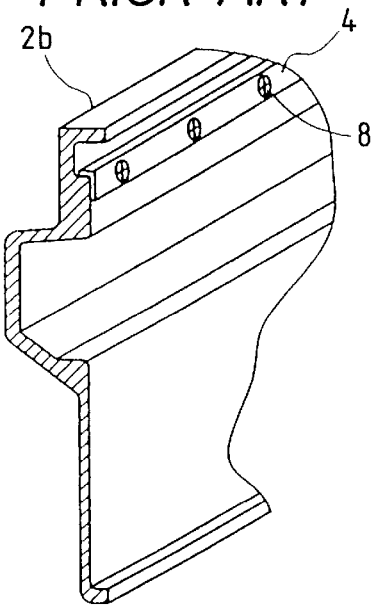
FIG. 6 PRIOR ART
FIG. 6 is a perspective view of a magazine and guide members of a conventional fastener driving machine.
Figure 7:
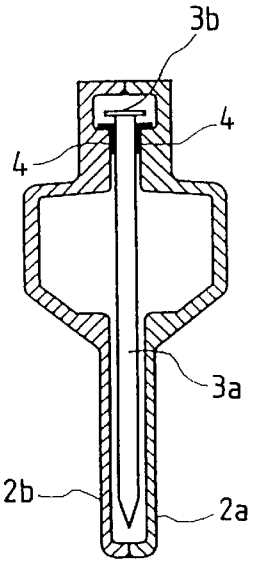
FIG. 7 PRIOR ART
FIG. 7 is a sectional view taken along the line 2—2 in FIG. 5.

As shown in FIGS. 2, 3 and 5, a magazine 2 includes a magazine body 2*a* and a magazine cover 2*b*. The magazine body 2*a* and the magazine cover 2*b* are both made of resin, and are secured to each other with screws 9 and a clamp 11. In an upper space inside the magazine 2 in the vicinity of a nose structure 1, a steel rail 10 adapted to support the heads 3*b* of nails 3 is provided in order to prevent the magazine body 2*a* and the magazine cover 2*b* from being damaged by the shock applied to the collated nails 6. The rail 10 is substantially C-shaped in section, having a groove in the bottom along which nail stems 3*a* are moved. In a lower space in the magazine 2, horizontal portions 4*c* of a guide member 4; that is, side portions of guide member 4, which extend longitudinally, are fitted in grooves 2*d* which are formed longitudinally in inner walls of the magazine 2 such that they are somewhat movable longitudinally. Thus, the guide member 4 is held in the magazine 2 but its motion is not restricted longitudinally. The guide member 4 is made of steel, and has a pair of guide surfaces 4*a*, which are the vertical portions thereof, to guide nail stems 3*a*. As is apparent from the above description, the rail 10 and the guide member 4 form a passageway through which collated nails 6 are fed to the nose structure 1.

Figure 1:
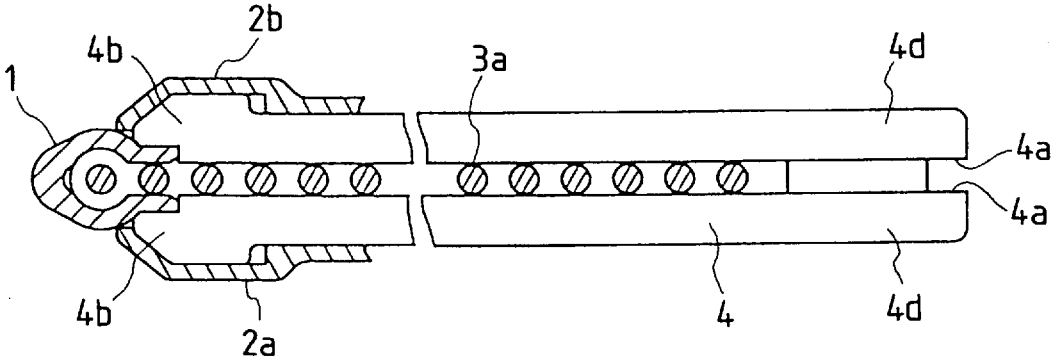
FIG. 1 is a sectional view of a preferred embodiment of the invention taken along the line 1—1 in FIG. 5.
Figure 4:
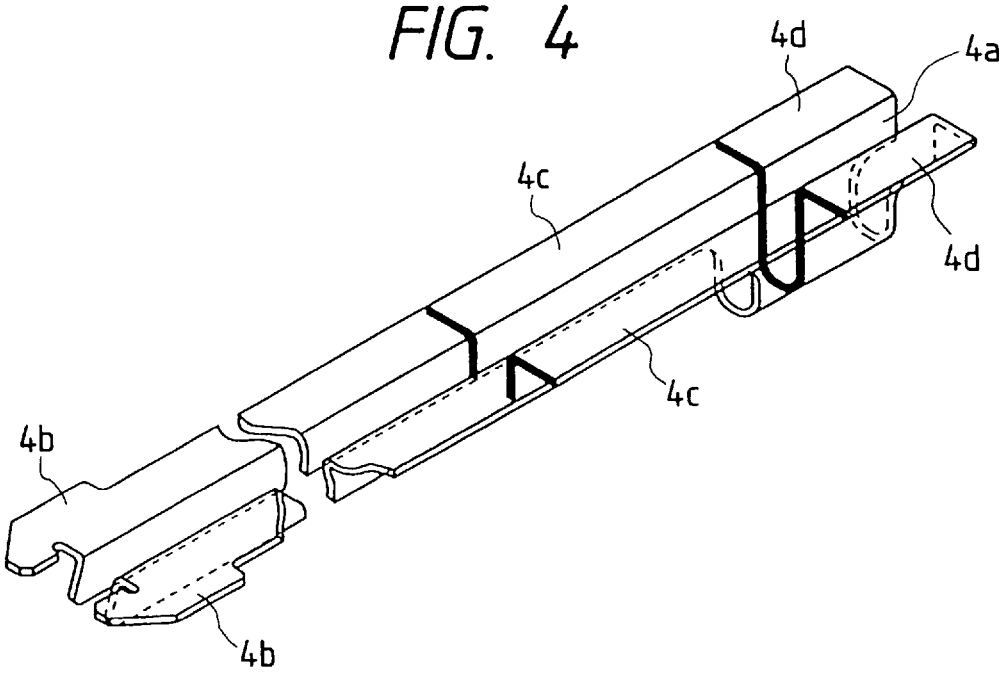
FIG. 4 is a perspective view showing an example of guide members in the fastener driving machine of the invention.

As shown in FIGS. 1 and 4, rear end portions 4*d* of the guide member 4, which are on opposite sides of the nose section 1, are connected to each other; and front end portions 4*b* of the guide member 4 are separated from each other to allow the nails 3 to move forward. Thus, the guide member 4 is substantially U-shaped. Note that the front end portions 4*b* of the guide member 4 are liable to be bent if left unsupported. If the front end portions 4*b* are bent, then the width of the passageway is changed. In order to prevent them from bending, the front end portions 4*b* are held between the nose structure 1 and the magazine halves 2*a* and 2*b*.

In this embodiment, the steel guide member 4 is not secured to the magazine 2 with screws or the like. Instead, the horizontal portions 4*c* of the guide member 4 are fitted in the grooves 2*d* which are formed longitudinally in the inner walls of the magazine 2. Hence, even when the environmental temperature where the nail driving machine is in use varies and the magazine 2 and the guide member 4 differ in their rates of thermal expansion or contraction, since the guide member 4 expands or contracts longitudinally, the guide member 4 never bends, and the width of the nail passageway is maintained unchanged.

As was described above, in the fastener driving machine of the inventions in order to prevent wear of the fastener passageway in the magazine the steel guide member is provided in the magazine in such a manner that its motion is not restricted longitudinally, whereby even if the temperature of the magazine changes according to the environment which the nail driving machine is in use, the guide member will not be bent; that is, the width of the fastener passageway is maintained unchanged at all times. Hence, it never becomes impossible to feed the fasteners to the nose structure. Accordingly, resin may be used for the formation of a magazine to be used in even a large fastener driving machine, thus contributing to reduction of the weight of the machine.

While only one embodiment of the invention has been specifically described herein, it will be apparent that numerous modifications may be made thereto without departing from the spirit and scope of the invention.

What is claimed is:

1. A fastener driving machine comprising:

a machine body;

a nose structure for defining a drive track through which fasteners pass to be ejected, said nose structure being fastened to said machine body;

a magazine made of resin for accommodating said fasteners collated in a row therein;

a metal guide member, disposed in said magazine, said guide member having a pair of opposing guide surfaces;

a feeder for feeding said collated fasteners to said nose structure while said collated fasteners are guided between said opposing guide surfaces; and means for supporting said guide member in said magazine so as to allow said guide member to longitudinally expand and contract with a change in temperature.

2. A fastener driving machine as claimed in claim 1, wherein said guide member is made of steel.

3. A fastener driving machine as claimed in claim 1, further comprising a rail made of metal, provided in an upper space inside said magazine, for supporting heads of said fasteners.

4. A fastener driving machine as claimed in claim 3, wherein said rail is made of steel.

5. A fastener driving machine as claimed in claim 1, wherein said supporting means comprises a groove portion formed on each of opposite inner surfaces of said magazine, said guide member engageable with said groove portion.

6. A fastener driving machine as claimed in claim 1, wherein said guide member is substantially U-shaped, and an open end of said guide member is in proximity to said nose structure.

7. A fastener driving machine as claimed in claim 6, wherein said open end of said guide member comprises two end portions, and wherein both said end portions are held between said nose structure and said magazine.

8. A fastener driving machine as claimed in claim 1, wherein said opposing guide surfaces of said guide member are planar.

9. A magazine made of resin for accommodating fasteners collated in a row therein, for use in a fastener driving machine of the type comprising a machine body, a nose structure for defining a drive track through which fasteners pass to be ejected, said nose structure being fastened to said machine body, and a feeder for feeding said collated fasteners from said magazine to said nose structure, said magazine comprising:

a metal guide member disposed in said magazine, said guide member having a pair of opposing guide surfaces for guiding said collated fasteners; and means for supporting said guide member in said magazine so as to allow said guide member to longitudinally expand and contract with a change in temperature.

10. A magazine as claimed in claim 9, wherein said guide member is made of steel.

11. A magazine as claimed in claim 9, further comprising a rail made of metal, provided in an upper space inside said magazine, for supporting heads of said fasteners.

12. A magazine as claimed in claim 10, wherein said rail is made of steel.

13. A magazine as claimed in claim 9, wherein said supporting means comprises a groove portion formed on each of opposite inner surfaces of said magazine, said guide member engageable with said groove portion.

14. A magazine as claimed in claim 9, wherein said guide member is substantially U-shaped, with an open end of said guide member in proximity to said nose structure.

15. A magazine as claimed in claim 14, wherein said open end of said guide member comprises two end portions, and wherein both said end portions are held between said nose structure and said magazine.

16. A magazine as claimed in claim 9, wherein said opposing guide surfaces of said guide member are planar.

* * * * *